United States Patent [19]

Fleissner

[11] 4,259,853

[45] Apr. 7, 1981

[54] USING A CONTINUOUS OPEN-WIDTH WASHING MACHINE FOR PILE-STRUCTURED TEXTILES, AND EQUIPMENT THEREFOR

[75] Inventor: Hans Fleissner, Riehen-Basel, Switzerland

[73] Assignee: Vepa Aktiengesellschaft, Switzerland

[21] Appl. No.: 9,969

[22] Filed: Feb. 6, 1979

[30] Foreign Application Priority Data

Feb. 6, 1978 [DE] Fed. Rep. of Germany ..... 2805010
May 26, 1978 [DE] Fed. Rep. of Germany ..... 2822977

[51] Int. Cl.[3] ..... D06B 21/00; D06B 5/08

[52] U.S. Cl. ..... 68/5 D; 26/2 R; 68/13 R; 68/20; 68/158; 68/207; 68/DIG. 5

[58] Field of Search ..... 68/DIG. 5, 5 D, 5 E, 68/9, 13 R, 158, 207; 26/2 R; 8/1 XB, 149.1

[56] References Cited

U.S. PATENT DOCUMENTS

| | | | |
|---|---|---|---|
| 2,785,042 | 3/1957 | Grajeck et al. | 26/2 R X |
| 3,019,630 | 2/1962 | Fleissner et al. | 68/DIG. 5 |
| 3,270,532 | 9/1966 | Chaikin et al. | 68/DIG. 5 |
| 3,292,228 | 12/1966 | Tigner | 26/2 R |
| 3,447,346 | 6/1969 | Norton | 68/5 D |
| 3,608,340 | 9/1971 | Fleissner | 68/DIG. 5 |
| 3,739,436 | 6/1973 | Naujoks et al. | 26/2 R |
| 4,070,875 | 1/1978 | Kutz | 26/2 R X |

FOREIGN PATENT DOCUMENTS

| | | | |
|---|---|---|---|
| 2049885 | 4/1972 | Fed. Rep. of Germany | 68/5 D |

*Primary Examiner*—Philip R. Coe
*Attorney, Agent, or Firm*—Craig & Antonelli

[57] ABSTRACT

An apparatus for treating a length of textile material which has a pile surface includes at least one sieve drum washing bath for washing the entire width of the textile material to even out or level irregularities across the width of the pile surface, a first steamer unit for treating the washed textile material, a dye applicator unit for applying dye to the steamed and washed textile material and a second steamer unit for treating the dye-containing textile material with steam to fix the dye to the textile material. The sieve drum washing bath includes a sieve drum positioned within a container for the treatment liquid and is provided with a plurality of nozzle openings arranged within the container and spaced closely adjacent to the sieve drum for directing the treatment liquid in the form of a plurality of jets across the width of the textile material being supported on the sieve drum.

16 Claims, 4 Drawing Figures

USING A CONTINUOUS OPEN-WIDTH WASHING MACHINE FOR PILE-STRUCTURED TEXTILES, AND EQUIPMENT THEREFOR

It is known to print or provide lengths of textile material with a single color and to fix the deposited dyestuff to the fiber with saturated steam in a steamer, to rinse dye-residues in sieve-drum washing machines and then to dry the length of textile material on a sieve-drum dryer. The length of textile material, especially pile-textured lengths of carpet, if equipped with backing made of synthetic fibers, will change dimensions during dye-fixing in the steamer, this being due especially to lack of uniformity in the backing; therefore it is in the state of the prior art to fix the textiles before dyeing. To that end the textiles may be guided while being stressed on a sieve drum subjected to suction and a gas raised to at least 100° C. may be made to flow through them. Such a step results in simple motion of the textiles through the dye-fixing steamer.

It has been found with respect to continuous dyeing of pile textured textile materials that in spite of the step taken to pre-fix the textiles and uniform dyestuff deposition across the operational width, streaks will occur in the longitudinal direction of the textiles. This lack of uniformity in color tone has been traced to varying preparations for the individually used tufted yarns, to unevenly twisted yarns and to uneven tufting.

The invention addresses the problem of taking steps in such a continuous manufacturing process for eliminating such differences in dyeing and such lengthwise streaks in pile-structure textiles.

This problem is solved by the invention by using a continuous open-width washing machine, preferably and/or a continuous steamer, immediately before a dyestuff deposition device with subsequent dye-fixing steamer, washing machine and dryer, only for smoothing irregularities in the pile of a length of textile across the surface of latter, especially across the width. Accordingly the purpose of the open-width washing machine—which advantageously is designed as a sieve-drum washing machine—is to even the irregularities that occurred during pile manufacture. As already stated, this relates to rinsing away various preparations, to leveling the twists of the yarns used and to equalizing pile which is not quite uniform. While it is known to wash the textiles after they leave the dye-fixing steamer for the purpose of rinsing the residual dyestuffs, it is not obvious, on the other hand, to add the same procedure prior to the deposition of the dyestuffs.

It was found advantageous that in addition to the washing process, the length of textile be moved through a steamer inside which the material need not be held as a surface, for instance through a steaming duct, and to set the textile into rhythmic motion where possible, for instance by means of an impacting roller, so that stresses in the pile will be compensated in an atmosphere of steam. Dyestuff deposition takes place immediately thereafter, offering the advantage that the material will then be heated.

An object of the continuously operating equipment furthermore is a system for the wet-treatment of lengths of textiles in a treatment-bath containing a liquor and comprising a sieve-drum rotatably mounted therein, the liquid flowing from the outside to the inside of said drum. It is known in the prior art to mount a device with nozzles a slight distance above at least part of the sieve-drum surface covered with liquid.

This device for increasing the washing efficiency on the basis of a high rate of liquor supply is disclosed in German Offenlegungsschrift No. 21 04 917. The advantage of this design is the production of turbulence in the vicinity of the surface of the textile touching the sieve-drum surface. Where pile fibers are concerned, they are pointed in all directions by such turbulence, and soil caught between them is accordingly detached more quickly. However this advantage is degraded by the fact that the textile exiting from the machine has a pile directed at random. In fact the pile fibers turned in all directions even are pressed at the first reversing roller of the washing machine in part into an undesired direction, and subsequent treatment can hardly correct this effect.

Accordingly the sieve-drum washing machine of this design is desired to be improved especially for this application, namely to wash carpets, in such manner that despite the generation of turbulence due to a high rate of liquid feed, textiles especially with sensitive pile will leave the machine with their pile surface in a given direction.

Significant improvement is achieved when the nozzles are in the form of spaced slits stretching along the width of operation. Thereby the length of material will be evenly supplied across the width of operation with a directed flow. While the pile yarns will also follow the turbulence in this case, such turbulence is uniform and mainly in one direction.

It is advantageous to work on the alignment of the pile yarns after passing a slit. This is advantageously implemented by using slit legs pointing at the sieve-drum surface. If these legs are arranged to taper in direction of the sieve-drum, the nozzle effect may be increased. If additionally the legs are pivoted in either direction, pile alignment may be achieved with simultaneous eddying of the pile fibers.

It is especially advantageous that the two legs of a slit terminate at different distances from the sieve-drum surface. Accordingly the legs are uniformly and essentially perpendicular to the sieve-drum surface. However one is longer than the other. If for instance the of a slit in the first part of the sieve-drum surface—as seen in the direction of motion—are resp. long and short, and in the second part resp. short and long, then the pile fibers in the first part of the sieve-drum surface will be deflected downward when in the region of the slit, that is, in the direction of the moving material. If on the other hand the sieve-drum is again moving upward, the pile requires being lined-up opposite the direction of motion so there be no danger of bending the pile fibers at the first reversing roller associated with the sieve-drum. Accordingly the legs of the particular slits in this second and upward-moving part of the sieve-drum must first be short and then long, whereby the flow will be directed down, and whereby the desired effect of pile alignment is achieved.

By means of this special liquor control, it is possible to achieve a motion of the pile tufts over the entire drum circumference—in addition to obtaining a good and uniform washing effect—, a specific direction being always imparted to the pile in segments. Irregular lay of the pile is avoided thereby and a good bulking effect is obtained. The stress-free motion on the sieve-drum allows releasing the stresses in the length of carpet and furthermore obtaining good shrinkage compensation in same.

The drawing represents illustrative embodiments of equipment of the invention.

Figure 1:
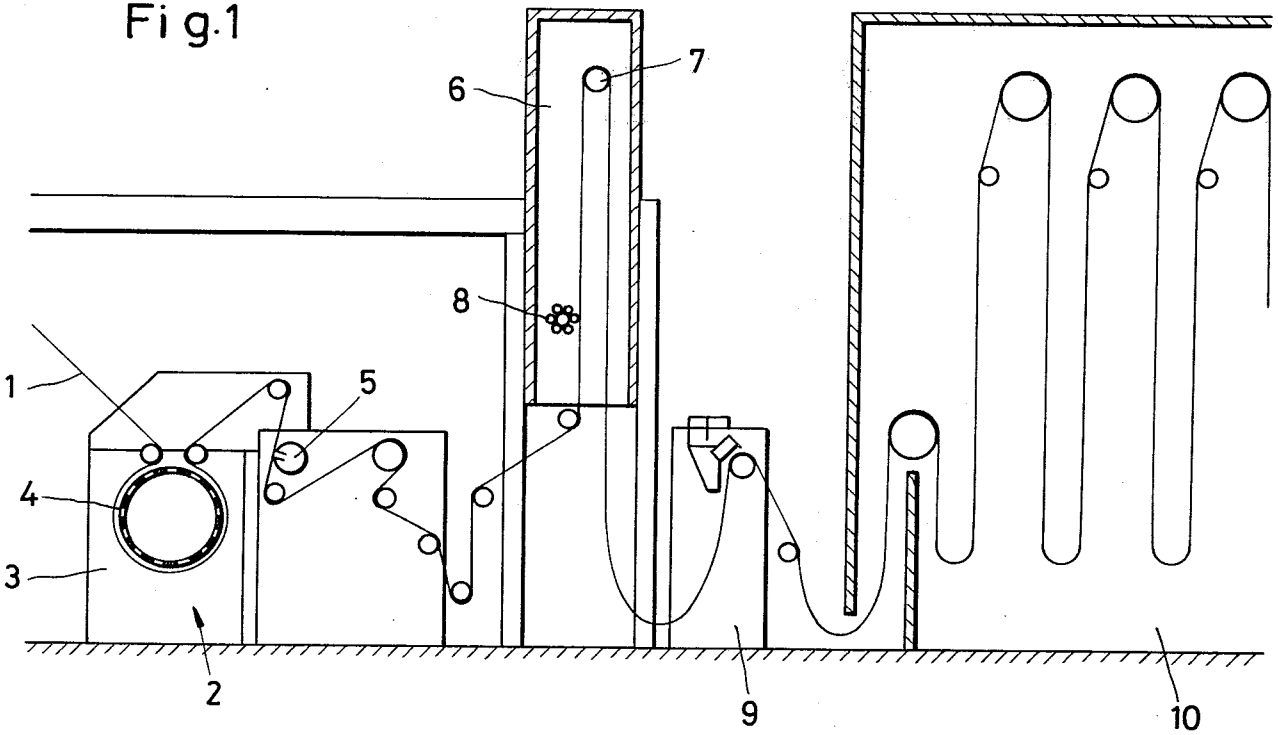
FIG. 1 is a cut-out of a continuous carpet-dyeing facility in the region of pretreatment before dyestuff deposition.

To equalize, to shrink irregularities across the surface of the length of textile 1 with a pile-textured structure, said length first is moved per FIG. 1 through a sieve-drum washing machine 2 comprising a rotatably supported sieve-drum 4 mounted in a liquid vessel 3, the liquid passing from the outside to the inside of said drum. Pre-washing in this sieve-drum bath 2 is implemented by a hot liquid at about 90° C. being forced through the run of material. The fibers are simultaneously fixed in this process, the preparations are rinsed, and a shrinkage due to fiber stress is released.

A rotatably mounted reversal roller 7 is located at the upper end of the steaming duct 6 for textile 1. One or more impacting rollers 8 are associated with the textile 1 on its way to the steamer, said impacting rollers rhythmically imparting motion to the pile side to achieve an additional equalizing effect, especially for unevenly made rows of tuft.

Immediately thereafter, the still warm textile 1 is moved back to the dyestuff deposition device 9 which operates on the coating principle and ensures uniform deposition of the dye-liquor across the operational width. After dyestuff deposition, the textile passes through the continuous steamer 10 in the form of several loops. The washing and drying machines follow the steamer in manner known per se.

Figure 2:
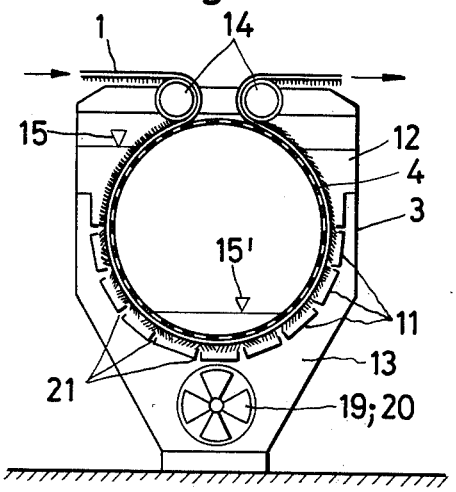
FIG. 2 is a cross-section of a sieve-drum washing machine of FIG. 1.
Figure 4:
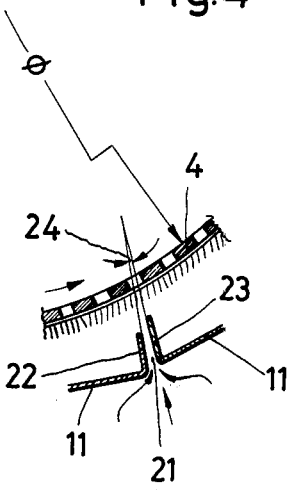
FIG. 4 is an enlarged partial cut-out from FIG. 1 in the region of the sieve-drum wall.
Figure 3:
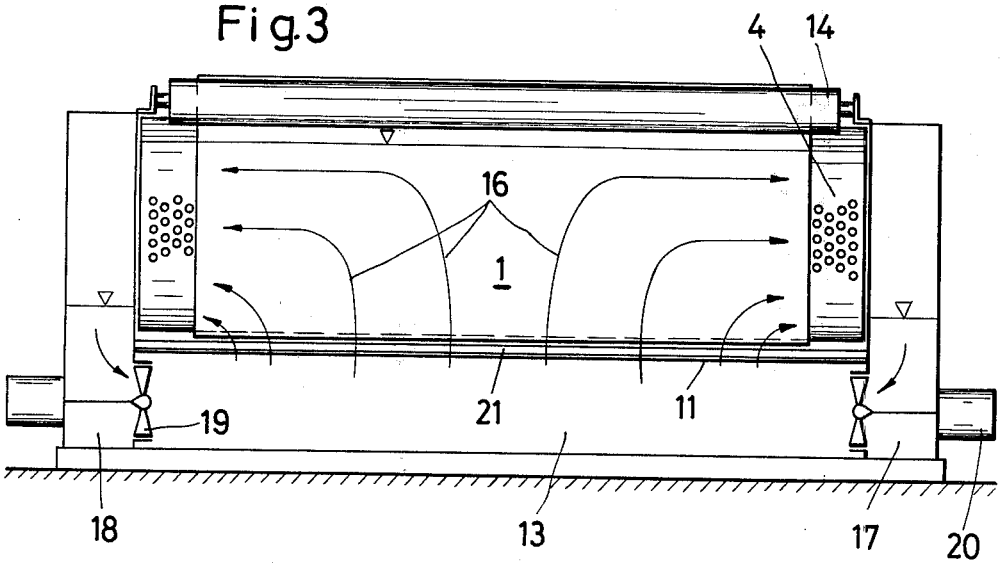
FIG. 3 is a longitudinal section through the washing vessel of FIG. 2.

The washing machine 2 may furthermore be of special design as indicated in FIGS. 2–4 and consists of a liquid container 3 divided by plates 11 into a processing chamber 12 and a liquid intake chamber 13. A sieve-drum 4 is rotatably mounted to the end walls of liquid container 3 and receives and discharges by means of reversing rollers 14 the wet-processed material 1.

Outside the sieve drum, in the processing chamber, the processing liquor rises to level 15, the level inside the sieve drum being 15'. Because of the difference in levels, the processing liquor automatically flows through the material and thus transversely through the wall of the sieve drum. If the material 1 is impermeable to liquids, or only slightly permeable, a liquid flow shown by arrows 16 in FIG. 3 will arise parallel to the surface. Regardless of the processing liquor passing through material 1 or passing only alongside it through the uncovered perforations to arrive in the sieve drum, the liquor will automatically flow out of the two end faces of the drum under the influence of gravity into catching vessels 17 and 18, as shown in FIG. 3, and from there it is conveyed by means of pumps 19, 20 into the liquid intake chamber 13, and then again reaches the processing chamber 12.

To increase the liquid intake rate to achieve a nozzle or slit washing effect, plates 11 are mounted concentrically around and close to the sieve-drum 4 and between the processing chamber 12 and the liquid intake chamber 13. Depending on the spacing between the particular plate 11 from the sieve drum 4 or material 1 and on the design of the nozzle 21 between these plates, an increased pressure will build up in the liquid intake chamber 13, which will be converted into higher kinetic energy as the liquor passes through the apertures 21. The liquid jets then will impinge with greater force on the surface of the material and thereby cause a higher washing effect. This improved washing effect essentially is due to the generation of turbulence arising from the impact of the well-defined liquid jet on the area of the material surface. This turbulence or eddying is advantageous to that extent, but also suffers from the drawback that it affects for instance soft materials, that is textiles with pile surfaces, as regards the pile position. Accordingly the nozzles are shown in the design of slits 21 in FIG. 2, which extend with their axes parallel across the operational width. These slits furthermore are spaced from each other in such manner that they will generate turbulence between the aimed liquid jets, such turbulence temporarily displacing the pile which however will rearrange itself uniformly when in the vicinity of the nozzles across the entire operational width. The pile schematic in FIG. 2 is referred to in this regard.

The different lengths of legs 22, 23 forming the slits 21 and converging in the direction of sieve 4, that is, forming an angle 24 for the purpose of increasing the rate of flow, offer an especial advantage. As shown in FIG. 4, the left leg 22, the first one seen in direction of motion, is shorter than the next leg 23 of the next plate 11. Thereby the liquid jet first is deflected to the left, so that the pile will be laid over to the left. An advantage is obtained here in the upward moving part of the drum, namely the pile will always be turned downward and thus the pile can pass over the second roller 14 without danger of being kinked. The same effect may also be achieved by aligning the slits, but this would require greater labor or assembly. Appropriately the legs ought to be of the inverse design on the left, downward moving part of the sieve drum, that is, first a long one, then a short one, so as to move the pile there too downward, and so as to achieve an overall change in pile direction over the length of guidance of one drum.

I claim:

1. An apparatus for treating a length of textile material having a pile surface which comprises means for washing the entire width of the textile material with a treatment liquid to equalize irregularities across the width of the pile surface; a first steamer unit for treating the washed textile material to a steam-containing atmosphere; means for applying the dye to the steamed and washed textile material; and a second steamer unit for treating the dye-containing textile material with steam to fix the dye to the textile material; said washing means including at least one sieve drum washing bath comprising a rotatably mounted sieve drum positioned in a liquid container containing the treatment liquid, said sieve drum having a sieve surface for supporting the textile material, being at least partly immersed within the treatment liquid, and being so arranged within the container that the liquid flows from the outside to the inside of said sieve drum and a plurality of nozzle openings arranged within said container and spaced closely adjacent to said sieve drum surface for directing the treatment liquid in the form of a plurality of jets across the width of the textile material being supported on said sieve drum.

2. An apparatus according to claim 1, further comprising a liquid suction drain means mounted downstream of the sieve drum washing bath for removing excess treatment liquid from said textile material.

3. An apparatus according to claim 1, wherein the first steamer unit comprises a steaming duct closed at the top and including means for guiding the textile material from the bottom to the top and from the top to the bottom, said guide means comprising a rotatably supported reversing roller for the textile material mounted at the top of said steaming duct.

4. An apparatus according to claim 3, wherein at least one impact roller is associated with the textile material along the path of the textile material within the steaming duct.

5. An apparatus according to claim 1, wherein said plurality of openings are arranged in form of mutually spaced slits over approximately 180° of the circumference of the sieve drum surface, said slits being provided by means extending across the operational width of the textile material.

6. An apparatus according to claim 5, wherein said means for providing said slits is a plurality of plates mounted concentrically around and close to the sieve surface of the sieve drum, said plates being provided with inwardly extending leg members, the leg members of adjacent plates together forming a slit through which the treatment liquid is passed in the form of a jet onto the sieve drum surface.

7. An apparatus according to claim 6, wherein said adjacent leg members are positioned to converge in the direction of the sieve drum thereby providing a tapered slit through which the treatment liquid passes.

8. An apparatus according to claim 5, wherein the liquid flow exiting from the slits is directed in the same direction as the direction of rotation in one portion of the sieve drum and opposite to the direction of rotation in another part of the sieve drum.

9. An apparatus according to claim 8, wherein said slits are defined by a plurality of plates mounted concentrically around and close to the sieve drum, said plates having leg members extending therefrom toward the sieve drum, the leg members of adjacent plates forming a slit therebetween, each slit being arranged to subtend an angle which on the upwardly moving portion of the sieve drum are slanted in the direction of the rotation of the sieve drum and on the downwardly moving portion of the sieve drum are slanted opposite to the direction of the sieve drum rotation.

10. An apparatus according to claim 9, wherein the two leg members forming a slit terminate at different distances from the sieve drum surface.

11. An apparatus according to claim 10, wherein the leg members defining a slit are, as seen in the direction of rotation of the sieve drum, first long and then short and in the second portion of the sieve drum, first short and then long.

12. An apparatus for treating a length of textile material having a pile surface which comprises means for washing the entire width of the textile material with a treatment liquid to equalize irregularities across the width of the pile surface, said washing means including at least one sieve drum washing bath comprising a rotatably mounted sieve drum positioned in a liquid container containing the treatment liquid, said sieve drum having a sieve surface for supporting the textile material, being at least partly immersed within the treatment liquid, and being so arranged within the container that the liquid flows from the outside to the inside of said sieve drum, and a plurality of nozzle openings arranged within said container and spaced closely adjacent to said sieve drum surface for directing the treatment liquid in the form of a plurality of jets across the width of the textile material being supported on said sieve drum.

13. An apparatus according to claim 12, wherein said plurality of nozzle openings are arranged in the form of mutually spaced slits over approximately 180° of the circumference of the sieve drum surface, said slits being provided by means extending across the operational width of the textile material.

14. An apparatus according to claim 13, wherein said means for providing said slits is a plurality of plates mounted concentrically around and close to the sieve surface of the sieve drum, said plates being provided with inwardly extending leg members, the leg members of adjacent plates together forming a slit through which the treatment liquid is passed in the form of a jet onto the sieve drum surface.

15. An apparatus according to claim 14, wherein said adjacent leg members are positioned to converge in the direction of the sieve drum thereby providing a tapered slit through which the treatment liquid passes.

16. An apparatus according to claim 15, wherein the liquid flow exiting from the slits is directed in the same direction as the direction of rotation in one portion of the sieve drum and opposite to the direction of rotation in another part of the sieve drum.

* * * * *